United States Patent [19]

Renjilian et al.

[11] 4,164,530

[45] Aug. 14, 1979

[54] METHOD OF MAKING MONOFILAMENT FROM THERMOPLASTIC RESIN TAPES

[75] Inventors: Armen Renjilian, Albany; Donald S. Nichols; Richard J. Hartigan, Jr., both of Delmar, all of N.Y.

[73] Assignee: Albany International Corp., Albany, N.Y.

[21] Appl. No.: 890,141

[22] Filed: Mar. 27, 1978

[51] Int. Cl.[2] ..... B29C 17/02

[52] U.S. Cl. ..... 264/103; 264/285; 264/291; 264/339

[58] Field of Search ..... 264/291, 288, 285, 339, 264/103, DIG. 47, DIG. 73, 285

[56] References Cited

U.S. PATENT DOCUMENTS

| | | | |
|---|---|---|---|
| 1,947,759 | 2/1934 | Cunningham | 264/DIG. 73 |
| 2,386,666 | 10/1945 | Dinsmore | 264/290 R |
| 3,018,610 | 1/1962 | Kleinekathofer | 264/103 |
| 3,287,893 | 11/1966 | Kleinekathofer | 264/103 |
| 3,332,228 | 7/1967 | Chill | 264/DIG. 47 |
| 3,364,289 | 1/1968 | Campbell | 264/103 |

FOREIGN PATENT DOCUMENTS

| | | | |
|---|---|---|---|
| 466016 | 5/1937 | United Kingdom | 264/339 |

*Primary Examiner*—James B. Lowe

*Attorney, Agent, or Firm*—Kane, Dalsimer, Kane, Sullivan andKurucz

[57] ABSTRACT

Monofilaments are made from films of unoriented, polymeric resin thermoplastics. The method comprises providing strips or tapes of the unoriented films, twisting the tapes into a generally cylindrical cross-section and drawing the twisted tape to obtain an oriented, round-in-cross-section, monofilament. In the preferred embodiment, molding is carried out by drawing down the twisted tape.

5 Claims, 5 Drawing Figures

METHOD OF MAKING MONOFILAMENT FROM THERMOPLASTIC RESIN TAPES

BACKGROUND OF THE INVENTION

1. Field of the Invention

The invention relates to methods of making monofilament yarns from thermoplastic resins.

2. Brief Description of the Prior Art

Prior to our invention, monofilament thermoplastic yarns useful, for example, in weaving and knitting fabrics were prepared by melt-spinning and solvent-spinning techniques; see for example U.S. Pat. Nos. 3,287,316 and 3,608,044. However, those skilled in the art appreciate that melt-spinning and solvent-spinning operations require substantial investment in capital machinery such as extruders, spinnerets and the like. In addition, many thermoplastic polymeric resins such as for example poly (ethylene oxide) are difficult and even impossible to spin into acceptable monofilament forms.

By the method of our invention, monofilaments of any thermoplastic polymeric resins may be readily and conveniently made from flat films of the resin. The apparatus required to carry out the method of the invention is relatively simple and inexpensive. The monofilaments prepared by the method of the invention are characterized in part by their advantageous, round cross-sectional configurations. The rounded monofilaments are usefully employed in weaving and knitting a wide variety of fabrics.

In certain embodiments of the invention, films of thermoplastic polymeric resins are drawn or molecularly oriented as a step in the method of the invention. Such orientations are generally well known in the prior art; see for example U.S. Pat. Nos. 3,400,193; 3,444,683; 3,448,187; and British Pat. No. 1,067,514.

SUMMARY OF THE INVENTION

The invention comprises a method of preparing a monofilament of a thermoplastic polymeric resin, which comprises;

- providing the thermoplastic polymeric resin in the form of a tape, the molecular structure of the tape being directionally unoriented;
- twisting the tape to form a generally cylindrical cross-section;
- molding the twisted tape under heat and pressure to form a monofilament with a round cross-section; and
- orienting the molecular structure of the molded tape, along its lengthwise axis.

The term "monofilament" as used throughout the specification and claims means a single filament of man-made (synthetic) textile fiber having sufficient size to function as a yarn in conventional textile fabric manufacture.

The term "tape" as used herein means an elongate, narrow strip or band of film formed from a thermoplastic, synthetic, polymeric resin.

DETAILED DESCRIPTION OF THE PREFERRED EMBODIMENTS OF THE INVENTION

Figure 1:
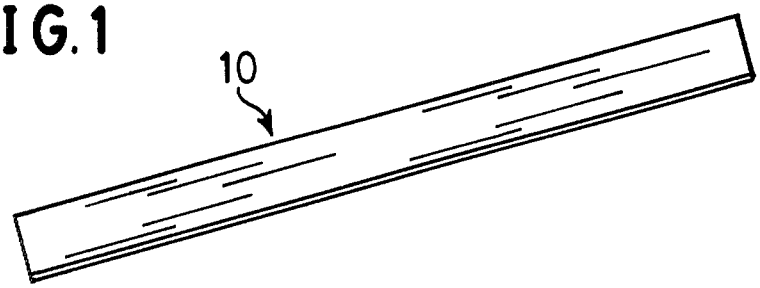
FIG. 1 is a view-in-perspective of a tape of a polymeric resin as provided in the method of the invention.

The method of the invention may be carried out by first providing a tape 10 of a thermoplastic, polymeric resin as shown in FIG. 1, a view-in-perspective. The tape 10 may be of any organic thermoplastic, polymeric resin such as, for example, polyolefins such as polyethylene polypropylene, and polyisobutylene, polyester such as polyethylene terephthalate, polyamides such as polyhexamethylene, polyvinyl chloride, polystyrene, poly (ethylene oxide) and like polymeric resins capable of being formed into films. The tape 10 is of a length, width and thickness suitable for redistribution into the form of a monofilament as will be described in greater detail hereinafter. The length, width and thickness selected will depend upon the nature of the polymeric resin employed and the conditions of the method of the invention imposed on tape 10. In general, those skilled in the art will appreciate that trial and error techniques may be employed to determine optimum lengths, widths and thicknesses for the tape 10. The tape 10 may be prepared from wider sheets of resin films by slitting the wider sheets. The molecular structure of the tape 10 and the sheets from which it may be slit should be unoriented i.e.; the tape 10 or film from which tape 10 is prepared should not have been previously stretched to a maximum elongation at a temperature above the glass-transition temperature for the resin making up the film or tape 10. It will be appreciated that partially oriented films or tapes 10 may be used, i.e.; the film or tape 10 may have been subjected to less than maximum elongation while at a temperature above the glass-transition temperature for the resin concerned.

Figure 2:
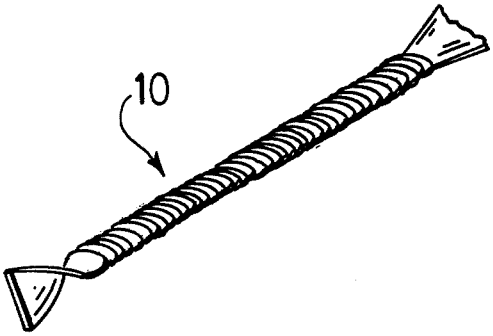
FIG. 2 is a view of the tape shown in FIG. 1, but following twisting to form a generally cylindrical cross-section.

The provided tape 10 is then twisted to form a generally cylindrical cross-sectional form as shown in FIG. 2. Twisting may be carried out on any conventional yarn twisting apparatus such as on a ring-spinning machine. Generally, continuous lengths of tape 10 may be twisted to a variety of degrees, depending on the degree of roundness desired in the product monofilament. The greater the degree of twisting, the greater will the roundness be in the product monofilament. Trial and error techniques may be used to determine optimum degrees of twisting for given widths and resins of tape 10. For larger diameter monofilament products, the tapes may be plied to build up their thickness.

The twisted tape 10 is then molded under heat and pressure to form a monofilament with a round cross-sectional configuration. The heat and pressure employed is that sufficient to fuse the twisted tape 10 and redistribute the resin content to form the desired monofilament. The monofilament form is then oriented to align the molecular structure of the resin with the lengthwise axis of the monofilament form. This orientation may be affected by stretching the monofilament form along its lengthwise axis, employing conventional and known apparatus, while the form is at a temperature above the glass-transition temperature of the resin from which the form is fabricated. Upon cooling, the desired monofilament is obtained.

Figure 3:
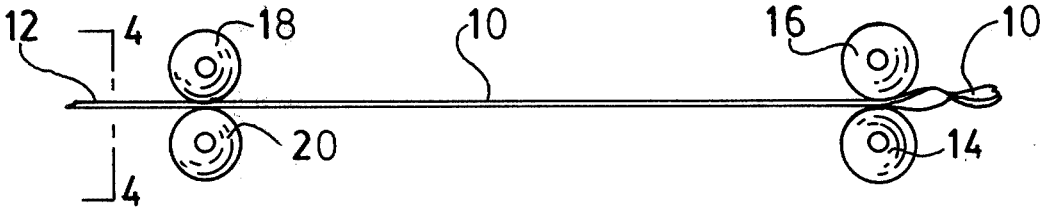
FIG. 3 is a plan view of a drawing operation wherein the twisted tape of FIG. 2 is drawn to simultaneously mold and orient the molecular structure of the twisted tape.
Figure 4:
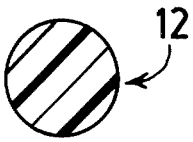
FIG. 4 is a cross-sectional view along lines 4—4 of FIG. 3.
Figure 5:
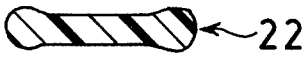
FIG.5 PRIOR ART
FIG. 5 is a cross-sectional view of a drawn tape as known in the prior art.

In a preferred embodiment process of the invention, molding and orientation of the tape 10 are carried out simultaneously by drawing the twisted tape 10. As shown in FIG. 3, a plan view of a drawing operation, twisted tape 10 is drawn (stretched) between Godet rollers 14, 16 and 18, 20 to obtain the monofilament 12. As shown in FIG. 4, a view along lines 4—4 of FIG. 3, the product monofilament 12 has a found cross-sectional configuration. The degree of stretching imposed on the twisted tape 10 will be dependent on the resin type which comprises the tape 10. Maximum draw ratios will vary from one resin type to another. In general, the draw ratio will be within the range of from about 2:1 to 15:1. Optimal draw ratios for given resin types will be readily determinable by trial and error techniques.

For a number of resin type, drawing of the twisted tape 10, carried out under room temperature conditions, will create by frictional energy sufficient heat and pressure to fuse the twisted tape 10 into the desired monofilament form. For other resin types having relatively higher glass-transition temperatures it may be necessary to pass the twisted tape 10 through a heating zone with the drawing. Heated Godet rollers 14, 16 may also be used to heat the twisted tape 10 just prior to drawing. In any event, the drawing according to the preferred method of the invention takes place when the twisted tape 10 resin is at or above its glass-transition temperature. The glass-transition temperature ($T_{(g)}$) refers to the temperature where a material on being advanced through (raising) will change from a solid to a visco-elastic state.

The following examples illustrate the manner and process of making and using the invention and set forth the best mode contemplated by the inventors but is not to be considered limiting. The test procedures used to characterize the monofilaments of the invention are as follows:

| | |
|---|---|
| Percent of Elongation | ASTM Test Method D-638-58T |
| Tensile Strength | ASTM Test Method D-638-58T |
| Tenacity | The average tensile strength in pounds as measured by ASTM Test Method D-638-58T converted to grams and divided by the average yarn weight per unit length in denier (grams/9000 meters). |
| Example | Tensile strength = 3.8 pounds force |

$$3.8 \text{ lbs} \times 453.6 \text{ gms/lb.} = 1723.7 \text{ gms force}$$

$$\text{Tenacity, gms/denier} = \frac{1723.7}{548} \frac{\text{gms}}{\text{denier}} = 3.1 \text{ GPD}$$

M.I.T. Flex Based on ASTM Folding Endurance Test Method D2176-63T, but modified for single yarns and monofilaments by welding 1/32" carbide rods to the tops of 0.06"–0.07" gapped jaws.

EXAMPLE 1

A sheet of 2 mil thick poly (ethylene oxide) film (Polyox, Union Carbide Corp.) was slit into a plurality of ½ inch wide strips. The strips were arranged in 2-ply lengths and twisted (Z twist, 1018 turns/72 inches or 14.1 turns/inch) together. The twisted 2-ply tapes were then drawn between Godets at a temperature of circa 26° C. and at a draw ratio of 3:1. The resulting round monofilament was characterized by the following physical properties.

| | | |
|---|---|---|
| Diameter (mils) | Average | 24.4 |
| | Range | 22.6 to 26.2 |
| Weight: Grains/100 yds. | | 410 |
| | Denier | 2615 |
| Tensile Strength, pounds/end | | 7.6 |
| Tenacity, G.P.D. | | 1.3 |
| % Elongation at: 1 G.P.D. | | 42.2 |
| | Break | 52.8 |
| M.I.T. Flex (cycles to failure) #2 Tester, 500 gram weight | | 933 |

EXAMPLE 2

A sheet of unoriented polyethylene film ¼" wide×9" long is twisted (10 turns per inch) then drawn cold, by hand, to 4 times its original length to obtain a pseudo-monofilament A.

Another sheet of unoriented polyethylene film ½" wide×9" long was twisted (10 turns per inch) then drawn by hand to 4 times its original length to obtain a pseudo-filament B. The resulting pseudo-monofilaments A and B were tested for physical properties. The test results are shown below.

| Filament | INitial Weight (gms/9000M) | Final Weight (gms/9000M) | Tensile Strength | Tenacity (G.P.D.) |
|---|---|---|---|---|
| A | 5,129 | 1,240 | 3.5 lbs. | 1.28 |
| B | 10,374 | 2,540 | 5.5 lbs. | 0.98 |

What is claimed is:

1. A method of preparing a monofilament of a thermoplastic polymeric resin, which comprises;

providing the thermoplastic polymeric resin in the form of a tape, the molecular structure of the tape being directionally unoriented;

twisting the tape to form a generally cylindrical cross-section;

heating the twisted tape at or above its glass transition temperature;

drawing the twisted tape whereby the pressure of drawing orients the molecular structure of the tape along its lengthwise axis and whereby the twisted tape is fused to form a monofilament with a round cross-section;

cooling the fused tape to a temperature below its glass transition temperature.

2. The method of claim 1 wherein said polymeric resin is poly (ethylene oxide).

3. The method of claim 2 wherein orienting is carried out by drawing the twisted tape at a 3:1 ratio.

4. The method of claim 1 wherein said tape is a 2-ply tape.

5. The method of claim 1 wherein twisting is at about 14 twists per inch.

* * * * *